US010473076B2

(12) United States Patent
Erdemir et al.

(10) Patent No.: US 10,473,076 B2
(45) Date of Patent: Nov. 12, 2019

(54) HIGH PRESSURE PUMP WITH PUMP SPRING SEALING SLEEVE

(71) Applicant: DELPHI TECHNOLOGIES IP LIMITED, St. Michael (BB)

(72) Inventors: Engin Erdemir, Bayrakli (TR); Gunay Cicek, Bornova (TR)

(73) Assignee: DELPHI TECHNOLOGIES IP LIMITED (BB)

( * ) Notice: Subject to any disclaimer, the term of this patent is extended or adjusted under 35 U.S.C. 154(b) by 0 days.

(21) Appl. No.: 16/062,464

(22) PCT Filed: Dec. 9, 2016

(86) PCT No.: PCT/EP2016/080398
§ 371 (c)(1),
(2) Date: Jun. 14, 2018

(87) PCT Pub. No.: WO2017/102579
PCT Pub. Date: Jun. 22, 2017

(65) Prior Publication Data

US 2018/0372044 A1 Dec. 27, 2018

(30) Foreign Application Priority Data

Dec. 16, 2015 (GB) ..... 1522211

(51) Int. Cl.
*F02M 59/10* (2006.01)
*F04B 1/04* (2006.01)
(Continued)

(52) U.S. Cl.
CPC ..... *F02M 59/102* (2013.01); *F02M 59/442* (2013.01); *F04B 1/0408* (2013.01);
(Continued)

(58) Field of Classification Search
CPC .. F02M 59/102; F02M 59/442; F04B 1/0408; F04B 1/0426; F04B 1/0448
See application file for complete search history.

(56) References Cited

U.S. PATENT DOCUMENTS 3,696,714 A * 10/1972 Panigati ..... F15B 15/1428 92/170.1
5,899,136 A * 5/1999 Tarr ..... F02M 59/442 123/495
(Continued)

FOREIGN PATENT DOCUMENTS

DE 102008002088 A1 12/2009
DE 102011089967 A1 6/2013
(Continued)

*Primary Examiner* — Hieu T Vo
(74) *Attorney, Agent, or Firm* — Joshua M. Haines

(57) ABSTRACT

A high pressure fuel pump has a piston extending outside a pump head toward an end provided with a spring seat cooperating with a cam follower. A pump spring compressed between the pump head and the cam follower maintains the follower in contact with a revolving cam. The pump is further provided with a flexible tubular sealing sleeve engaged around the piston and extending between the pump head and the cam follower so that the internal space of the sleeve is sealingly isolated from the outer space.

4 Claims, 3 Drawing Sheets

(51) Int. Cl.
*F02M 59/44* (2006.01)
*F04B 53/18* (2006.01)

(52) U.S. Cl.
CPC ..... *F04B 1/0426* (2013.01); *F04B 1/0448* (2013.01); *F02D 2200/0602* (2013.01); *F04B 53/18* (2013.01)

(56) References Cited

U.S. PATENT DOCUMENTS

| | | | | |
|---|---|---|---|---|
| 10,330,066 | B2 * | 6/2019 | Kulzer | F02M 59/485 |
| 2004/0113487 | A1 * | 6/2004 | Yang | B60T 8/4031 303/116.4 |

FOREIGN PATENT DOCUMENTS

| | | | |
|---|---|---|---|
| DE | 102013216983 | A1 | 3/2015 |
| DE | 102014202340 | A1 | 8/2015 |
| DE | 102014202571 | A1 | 8/2015 |
| DE | 102014206966 | A1 | 10/2015 |

* cited by examiner

HIGH PRESSURE PUMP WITH PUMP SPRING SEALING SLEEVE

CROSS REFERENCE TO RELATED APPLICATIONS

This application is a national stage application under 35 USC 371 of PCT Application No. PCT/EP2016/080398 having an international filing date of Dec. 9, 2016, which is designated in the United States and which claimed the benefit of GB Patent Application No. 1522211.0 filed on Dec. 16, 2015, the entire disclosures of each are hereby incorporated by reference in their entirety.

TECHNICAL FIELD

The present invention relates to an oil lubricated high pressure fuel pump and more particularly to a sealing device segregating the oil from the fuel.

BACKGROUND OF THE INVENTION

Fuel pumps used in fuel injection equipment of internal combustion engines use a cam-follower to follow a cam profile and translate rotational movement into reciprocating movement displacing the piston compressing fuel in a compression chamber.

A return spring mechanism supplies the required force to keep the cam and the cam-follower in a continuous contact.

The fuel is compressed by the displacement of the piston and reaches a high pressure level that can be 3000 bar. The piston is guided in the hydraulic head bore with a small and precisely controlled clearance and, some of the fuel can leak thought this clearance to the follower side during the pumping stage due to the pressure differences between the compression chamber just above the piston and the cam-follower side. In the oil lubricated fuel pump systems the cam-follower intersection is lubricated by engine oil.

The most critical problem of such oil lubricated fuel pump systems is separating the leaked fuel from the lubrication oil. If the lubrication oil and the fuel become mixed it can lead to engine damage. If a high quantity of oil is present in the fuel then this can lead for instance to injector damages or damages to particulate filters. Similarly a high level of fuel in the oil will compromise the oil lubrication thereby increasing engine wear.

The prior art is to separate the fuel and the lubrication oil using a matched length and/or a seal on the piston. However neither option is capable to separate the two liquids completely due to the movement of the piston.

SUMMARY OF THE INVENTION

Accordingly, it is an object of the present invention to resolve the above mentioned problems in providing a high pressure fuel pump of a fuel injection equipment, the pump having a pump head wherein a piston is axially slidably guided in a bore therein defining a compression chamber. The piston extends outside the pump head toward an end provided with a spring seat cooperating with a cam follower that is biased by a pump spring compressed between the pump head and the cam follower so that, the spring is adapted to maintain permanent contact with a revolving cam imparting reciprocate movement to the piston for varying the volume of the compression chamber.

The pump is further provided with a flexible tubular sealing sleeve engaged around the piston and extending between the pump head and the cam follower so that the internal space of the sleeve is sealingly isolated from the outer space.

The flexible sealing sleeve extends from a first annular sealing face, or upper face, maintained in sealing contact against a face of the pump head and, a second annular sealing face, or lower face, maintained in sealing contact against a face of the spring seat.

Also, the flexible sleeve is axially resilient, the sleeve being axially compressed between said face of the pump head and said face of the spring seat.

The sleeve has a resilient tubular body axially Z extending between said first annular sealing face and said second annular sealing face.

More particularly, the pump spring is a coil spring embedded in the resilient body and thus forming the sleeve.

In another embodiment, the sleeve comprises a sleeve spring embedded in the tubular body, said sleeve spring being distinct from the pump spring, More particularly, said sleeve spring embedded in the tubular body is a coil spring.

The invention also extends to a high pressure pump wherein the pump spring is a coil spring, a sleeve, as described before, the piston and the pump spring being coaxially arranged.

BRIEF DESCRIPTION OF THE DRAWINGS

The present invention is now described by way of example with reference to the accompanying drawings in which.

DESCRIPTION OF THE PREFERRED EMBODIMENTS

Figure 1:
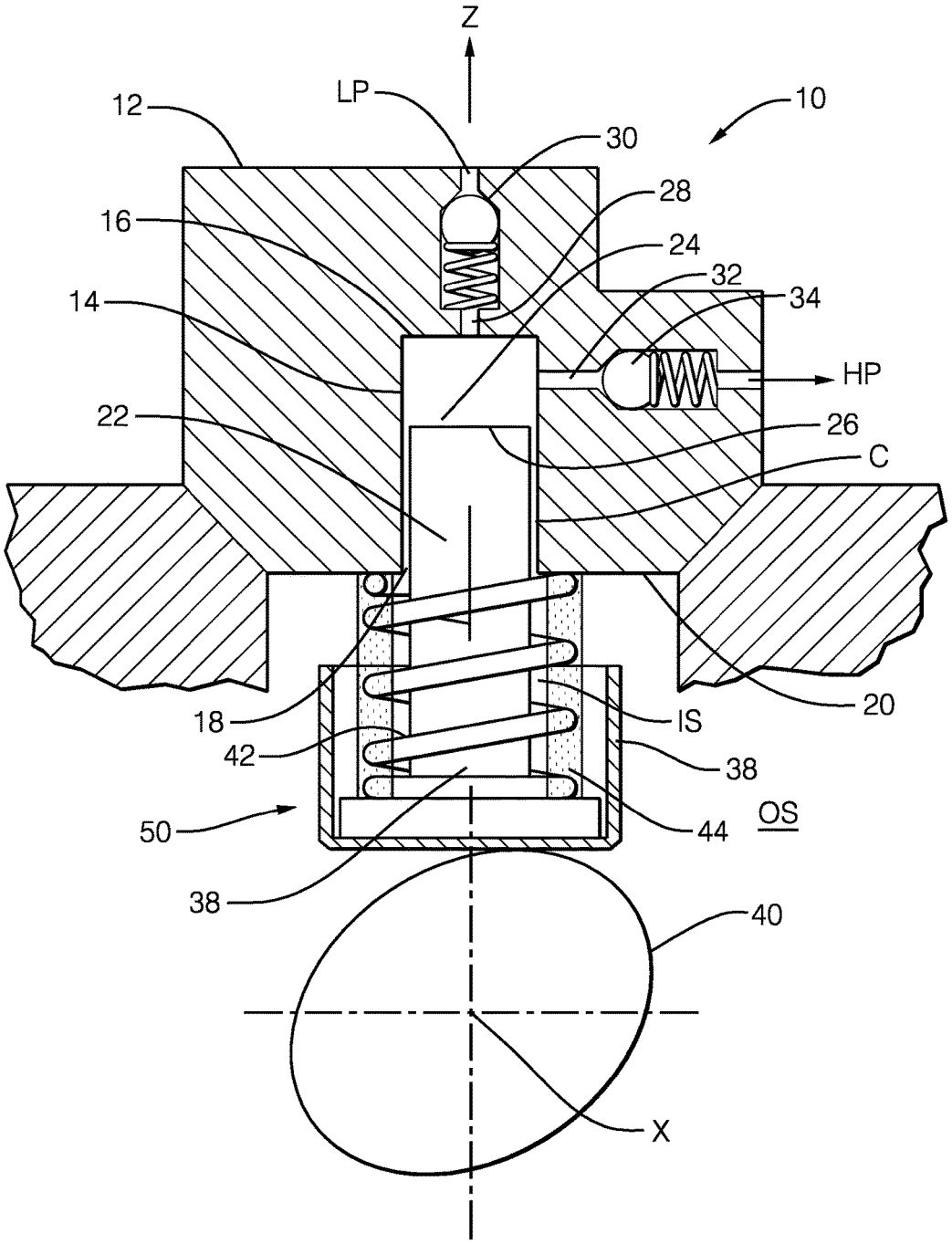
FIG. 1 is schematic view of a fuel pump as per the invention.

In reference to FIG. 1 is described a high pressure pump 10 fixed on an internal combustion engine and part of fuel injection equipment. The pump 10 has a pump head 12 provided with an internal blind bore 14 extending along a pumping axis Z from a blind end 16 to an open end 18 opening in an under face 20 of the pump head 12. In the bore 14, a piston 22 is adjusted with minor annular clearance C and slidably guided such that, a compression chamber 24 is defined between the top end 26 of the piston and the blind end 16 of the bore. In said compression chamber 24 opens an inlet 28 controlled by an inlet valve 30 and an outlet 32 controlled by an outlet valve 34. In use, low pressure LP fuel flows from a fuel tank, not represented, to the compression chamber 24 entering via the inlet 28, the inlet valve 30 preventing back flow toward the tank and, pressurized fuel HP flows out of the compression chamber 24 via the outlet 32 toward injectors, not represented, the outlet valve 34 also preventing back flow.

In this application reference is taken to the orientation of FIG. 1 and words such as "top, down, above . . . " may be utilized to ease and clarify the description without limiting the scope of the application.

The piston 22 is axially elongated and it protrudes outside the pump head 12 via the opening 18 of the bore. The piston 22 extends from said top end 26 inside the bore 14, to a bottom end 36 outside the pump head 12 where is arranged a cam follower 38 that is adapted to be in contact with the outer track of a cam 40 adapted to rotate about a cam axis X perpendicular to the pumping axis Z. A pump spring 42 arranged around the protruding portion of the piston is compressed between the under face 20 of the pump head and said cam follower 38, the spring 42 permanently biasing the follower 38 against the cam 40. Furthermore, the spring 42 is over-molded with flexible material, such as rubber based material, silicon or polymer based material, forming a tubular body 44 having a non-perforated lateral wall, said body 44, in which is embedded the pump spring 42, extending from an upper first transverse annular face 46, drawn maintained in sealing contact against the under face 20 of the pump head to, a lower second transverse annular face 48 maintained in sealing contact against the cam follower 38. The spring 42 integrally over-molded in the flexible body 44 form an elastic sealing sleeve 50, independently represented on FIG. 4, which sealingly isolate the inner space IS of said sleeve from the outer space OS of the sleeve.

In operation, fuel flows inside the pump head 12 while, outside the pump head, the cam 40 is lubricated by oil. The cam 40 rotates about the cam axis X and imparts to the piston 22 reciprocating movement axially Z defining a pumping cycle wherein the piston 22 translates between a top dead center TDC position, where the volume of the compression chamber 24 is minimized, and a bottom dead center position BDC, where the volume of the compression chamber 24 is maximized.

In an expansion phase of the pumping cycle, the piston 22 downwardly translates from TDC to BDC, fresh fuel at low pressure LP enters the compression chamber 24 via the inlet 28, the sealing sleeve 50 extends since to the pump spring 42 pushes the follower 38 away from the pump head 12.

In a following compression phase of the pumping cycle, the piston 22 upwardly translates from BDC to TDC, fuel in the compression chamber is pressurized and, the sealing sleeve 50 is compressed.

During said compression phase while high pressure builds in the compression chamber 24, low pressure remains outside the pump head 12 and particularly in the inner space IS of the sealing sleeve 50 and in the outer space OS. Some fuel leaks from the compression chamber 24 down to the inner space IS, via the annular clearance C that is between the piston 22 and the bore 14. Thanks to the sealing sleeve 50, said leaking fuel remains in the inner space IS and does not mix with the lubricating oil that is in the outer space OS. The inner space IS is therefore identified as the fuel side while the outer space OS is the oil side.

Specific embodiment of the invention generally described above is now detailed in referenced to FIGS. 2 and 3.

Figure 2:
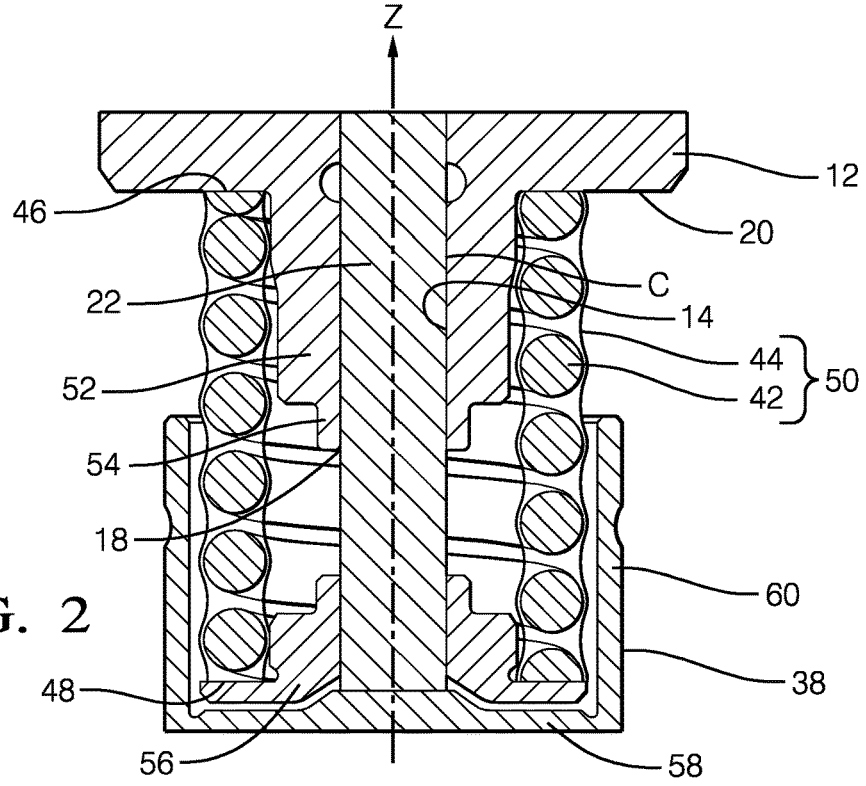
FIG. 2 is an axial section of a first embodiment of the pump as per the invention.

A first embodiment represented in FIG. 2 is similar to the previous general description.

The pump head 12 is provided with a turret protrusion 52 downwardly extending from the under face 20 toward a distal end 54. The bore 14 axially Z extends in the center of the turret 52 and opens in said distal end 54.

The bottom end 36 of the piston is provided with a spring seat 56 forming an annular collar, said spring seat 56 being fixedly attached to the piston 22 either by press-fitting, welding or any other fixation means.

Figure 4:
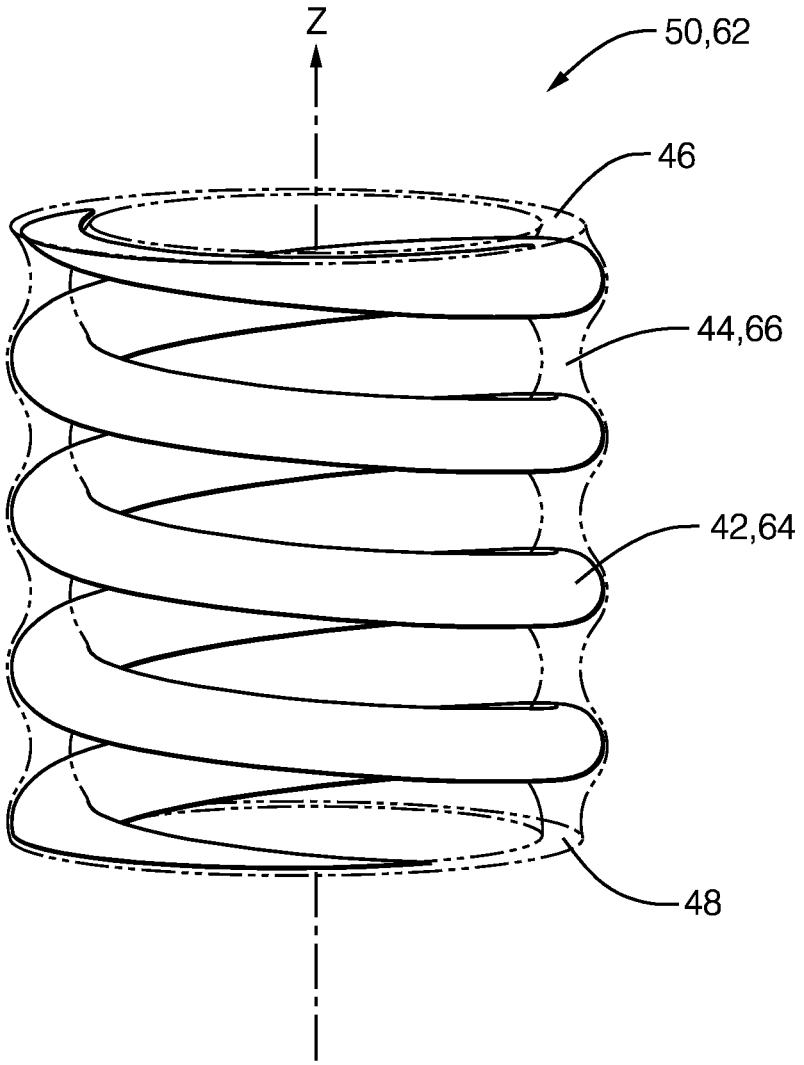
FIG. 4 is a detail of a sealing sleeve of the pumps of either FIG. 2 or 3.

The sealing sleeve 50 of FIG. 4 is the intimate integration of the pump spring 42 over-molded in a tubular body 44 of flexible material. The sleeve 50 is engaged around the piston and around the turret 52 and, it is compressed between the under face 20 of the pump head, where the first face 46 is in sealing contact against the annular portion of the under face 20 that surrounds the turret 52 and, the spring seat 56, where the second face 48 is in sealing contact against the annular collar of the spring seat.

The cam follower 38 has a cup-like shape with a transverse bottom wall 58 from the outer edge of which axially Z extends a peripheral wall 60 upwardly extending and, inside the cup-like lies the spring seat 56 that is in contact with the bottom wall 60. The sleeve 50 which upward portion is engaged around the turret 52 has its downward portion also inside the follower 38.

Figure 3:
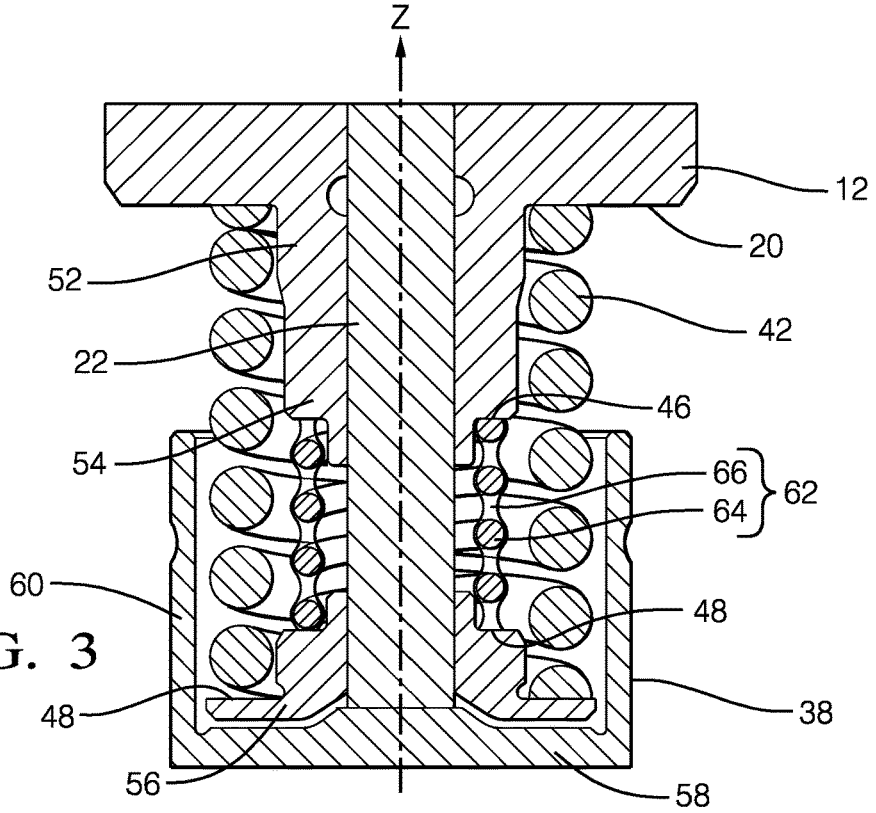
FIG. 3 is an axial section of a second embodiment of a pump as per the invention.

FIG. 3 depicts a second embodiment of the invention where the pump spring 42 is free of over-molding material, the lubricating oil and the leaking fuel being kept apart from each other by an independent sealing sleeve 62 which is a separate independent component comprising a sleeve spring 64 integrally over-molded in a tubular body 66 made of similar flexible material such as silicon, rubber, polymer as previously described . . . FIG. 4 is also representative of said independent sealing sleeve 62. The sleeve spring 64 is of smaller diameter than the pump spring 42 and, the sealing sleeve 62 is coaxially arranged around the piston and inside the pump spring 42, the sleeve 62 being compressed between the distal end 54 of the turret where the first face 46 is in sealing contact and, an annular face of the spring seat 56 where the second face 48 is maintained in sealing contact.

LIST OF REFERENCES

X cam axis
Z pumping axis
LP low pressure fuel
HP high pressure fuel
IS inner space of the sleeve—fuel side
OS outer space oil side—oil side
C clearance
10 pump
12 pump head
14 blind bore
16 blind end of the blind bore
18 open end of the blind bore
20 under face of the pump head
22 piston
24 compression chamber
26 top end of the piston
28 inlet
30 inlet valve
32 outlet
34 outlet valve
36 bottom end of the piston
38 cam follower
40 cam
42 pump spring
44 tubular body—over-molded body of the sealing sleeve
46 first face sealing face—upper face
48 second face sealing face—lower face
50 sealing sleeve
52 turret
54 distal end of the turret
56 spring seat
58 bottom wall of the cam follower
60 peripheral wall of the cam follower
62 sealing sleeve—second embodiment
64 sealing spring
66 over-molded body of the sealing sleeve

The invention claimed is:

1. A high pressure fuel pump of a fuel injection equipment, the high pressure fuel pump comprising:

a pump head wherein a piston is axially slidably guided in a bore therein defining a compression chamber, said piston extending outside said pump head toward an end provided with a spring seat cooperating with a cam follower that is biased by a pump spring compressed between said pump head and said cam follower so that it is adapted to maintain permanent contact with a revolving cam imparting reciprocate movement to said piston for varying volume of said compression chamber; and a flexible tubular sealing sleeve engaged around said piston and extending between said pump head and said cam follower so that an internal space of said flexible tubular sealing sleeve is sealingly isolated from an outer space; and wherein said flexible tubular sealing sleeve extends from a first annular sealing face maintained in sealing contact against a face of said pump head and, a second annular sealing face maintained in sealing contact against a face of said spring seat;

wherein said flexible tubular sealing sleeve is axially resilient, said flexible tubular sealing sleeve being axially compressed between said face of said pump head and, said face of said spring seat;

wherein said flexible tubular sealing sleeve has a resilient tubular body axially extending between said first annular sealing face and said second annular sealing face;

wherein said flexible tubular sealing sleeve comprises a sleeve spring embedded in said resilient tubular body, said sleeve spring being distinct from said pump spring, and wherein said sleeve spring is embedded in said resilient tubular body and is a coil spring.

2. A high pressure fuel pump as claimed in claim 1, wherein said pump spring is a coil spring embedded in a resilient body and thus forming a sleeve.

3. A high pressure fuel pump as claimed in claim 2, wherein said pump spring is a coil spring, said flexible tubular sealing sleeve said piston and said pump spring being coaxially arranged.

4. A high pressure fuel pump as claimed in claim 1, wherein said pump spring is a coil spring, said flexible tubular sealing sleeve said piston and said pump spring being coaxially arranged.

* * * * *